United States Patent [19]

Cherbonnier

[11] Patent Number: 4,662,786

[45] Date of Patent: May 5, 1987

[54] DYNAMIC LOAD COMPENSATING SYSTEM

[76] Inventor: T. Dave Cherbonnier, #152 Jalan Batalong, Singapore 1750, Singapore

[21] Appl. No.: 783,679

[22] Filed: Oct. 3, 1985

[51] Int. Cl.[4] ..... E21B 7/12; E21B 19/09

[52] U.S. Cl. ..... 405/195; 114/264; 166/355; 175/5; 267/160

[58] Field of Search ..... 405/148, 195, 196, 202, 405/205, 212, 214, 215, 211, 224; 114/264, 265; 267/160; 188/266; 166/350, 355, 359, 367; 175/5, 7; 248/588; 254/9 R

[56] References Cited

U.S. PATENT DOCUMENTS

| | | | |
|---|---|---|---|
| Re. 27,261 | 12/1971 | Bromell et al. | 114/264 |
| 2,842,939 | 7/1958 | D'Auriae | 405/214 |
| 3,472,032 | 10/1969 | Howard | 114/264 X |
| 3,714,995 | 2/1973 | Hanes et al. | 175/5 |
| 3,721,293 | 3/1973 | Ahlstone et al. | 175/5 X |
| 3,743,249 | 7/1973 | van Daalen | 175/7 X |
| 3,752,432 | 8/1973 | Lowe | 248/588 X |
| 4,379,657 | 4/1983 | Widiner et al. | 405/195 |
| 4,449,854 | 5/1984 | Nayler | 114/264 X |
| 4,511,115 | 4/1985 | Ludwigsen | 267/160 X |

FOREIGN PATENT DOCUMENTS

| | | | |
|---|---|---|---|
| 1920696 | 6/1978 | Fed. Rep. of Germany | 248/588 |
| 606919 | 5/1978 | U.S.S.R. | 405/203 |

*Primary Examiner*—Richard J. Scanlan, Jr.
*Assistant Examiner*—Nancy J. Stodola
*Attorney, Agent, or Firm*—William W. Haefliger

[57] ABSTRACT

A dynamic load compensation system comprises:

(a) a first element to receive predetermined applied loading, and a base spaced longitudinally from that element, (b) structure including articulated members supporting the first element on the base and acting to resist displacement thereof characterized in that the base may move relatively toward and away from the first element while such predetermined loading is applied to the first element, (c) certain of the members extending longitudinally and laterally leftwardly, and others of the members extending longitudinally and laterally rightwardly, (d) first connections including links pivotally interconnecting the certain members, and (e) second connections including links pivotally interconnecting the other members.

20 Claims, 15 Drawing Figures

HORIZONTAL DISPLACEMENT, PAIR

HORIZONTAL DISPLACEMENT, SINGULAR

FIG. 7.
ARTICULATED MEMBERS
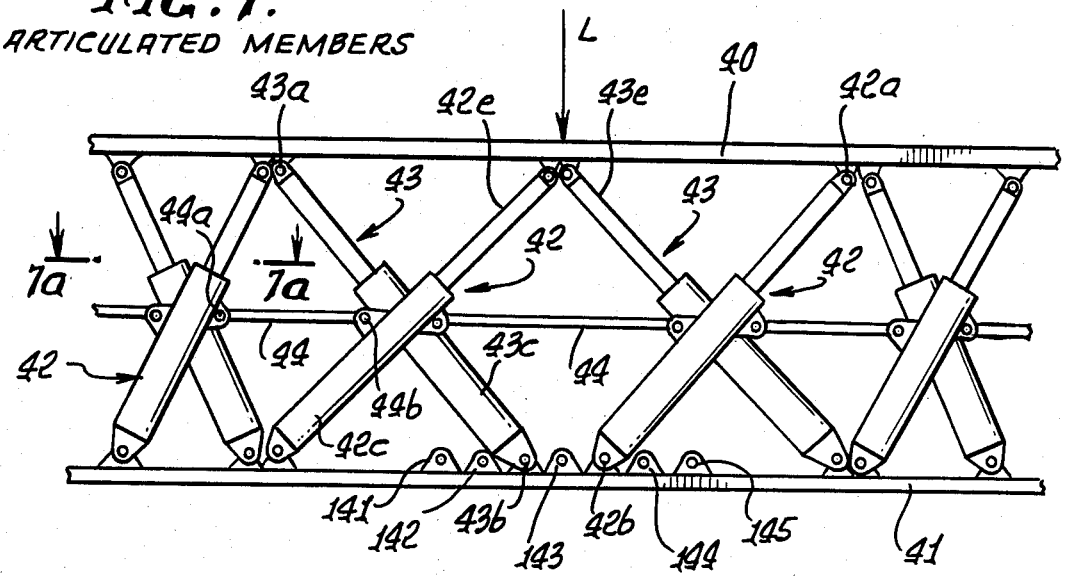
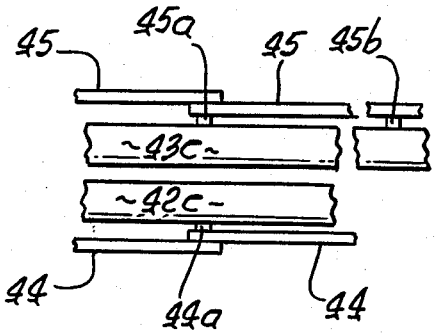
FIG. 7a.
FIG. 11.
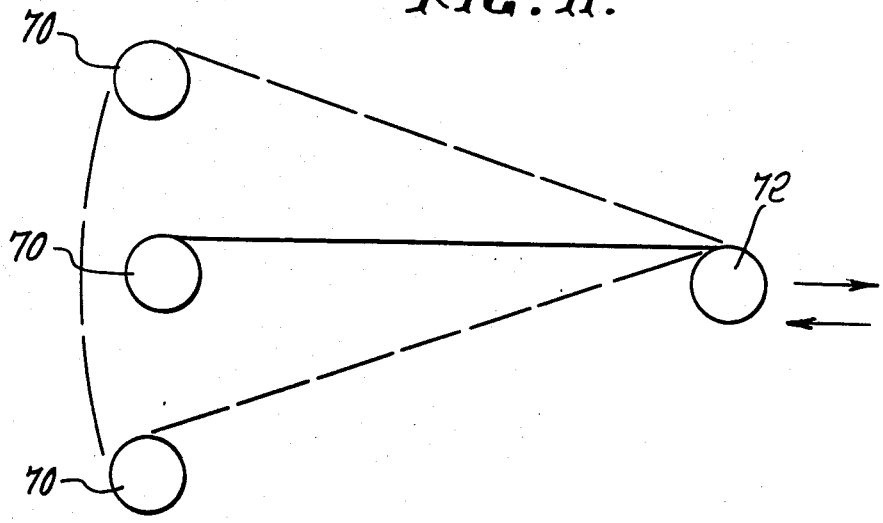

FIG. 9.
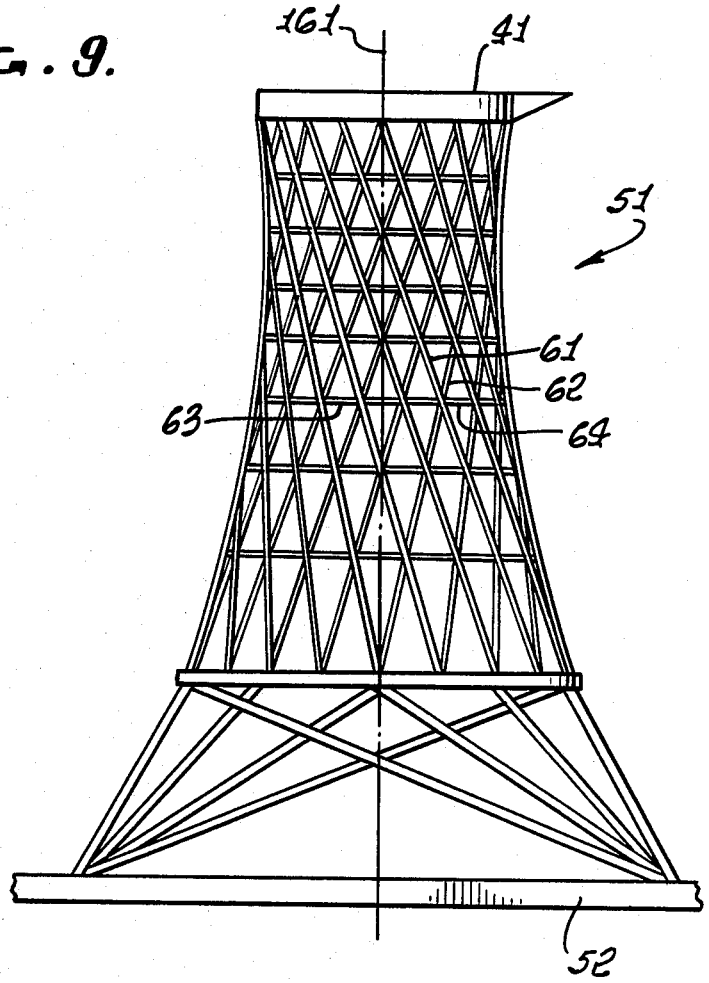
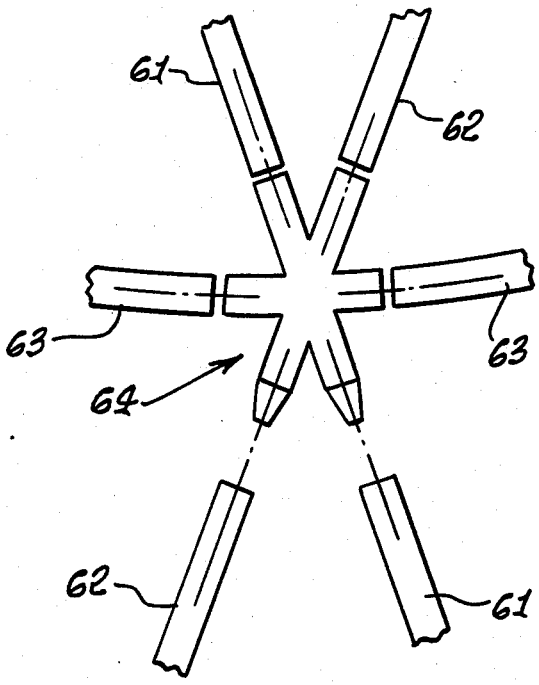
FIG. 10.

DYNAMIC LOAD COMPENSATING SYSTEM

BACKGROUND OF THE INVENTION

This invention relates generally to motion compensation, and more particularly to improvements in heavy duty compensating devices making them simpler, more effective and reliable.

There is need for simple, effective, reliable, heavy duty, motion and load compensating equipment. For example, helicopter landing pads should support a predetermined load and dissipate additional loading, to compensate for and nullify additional forces exerted as a result of deck "heave," on a vessel. A desirable "shock deck" should also compensate for a "hot" landing or inadvertent rapid descent rate, of the helicopter, and which might otherwise adversely affect the structual integrity of the deck support structure.

In the case of a floating offshore drilling vessel, it cannot inherently provide a constantly stable platform as related to the sub-sea well head. In this regard, a stable reference is required for landing and retrieving of wellhead and blow out prevention equipment, control of string weight on the drill bit in the hole, landing of casing and liner, coring, well logging and fishing. There is need for nullification of the effects of rig/platform heave in response to swelling seas, and for compensation apparatus that will maintain a predetermined lifting force.

Prior Drill String Compensators (D.S.C.'s) sometimes called heave compensators, are of two types:

1. Block mounted, or
2. Crown mounted Block mounted compensators, substantially increase the weight applied to the draw works, require precise alignment of derrick track and dollys, and represent a substantial change in the deck loading arm by their movement up and down the derrick. Crown mounted compensators, overcome these major disadvantages, but still add a significant weight to the crown of the derrick. These two methods share some common disadvantages:

1. Stroke/compensation length is equal to rod length or must incorporate chains and sheaves which add additional wear/failure areas.
2. Rig heave compensation causes compression or expansion of compressed air, which in turn causes an inverse reaction in the compensating force applied.

SUMMARY OF THE INVENTION

It is a major object of the invention to provide a compensation system meeting the need as referred to, and overcoming disavantages of prior compensators. Basically, the system of the invention comprises (a) a first element such as a platform to receive predetermined applied loading, and a base spaced longitudinally form said element, (b) means including articulated members supporting said first element on said base and acting to resist displacement thereof characterized in that the base may move toward and away from said first element while said predetermined loading is applied to said first element, (c) certain of such members extending longitudinally and laterally leftwardly, and other of the members extending longitudinally and laterally rightwardly, (d) first connections pivotally connecting said certain members, and (e) second connections pivotally connecting said other members.

As will appear, fluid type motion dampers are operatively connected to the articulated members to yieldably resist their pivoting, such dampers typically including pistons working in cylinders against fluid adapted to be increasingly or decreasingly compressed; and the pistons are so connected as to be displaced as a function of angular pivoting of the members relative to said platform, whereby the extent of piston displacement decreases as the base moves upwardly toward the platform.

In one form of the invention, the dampers are offset from the platform and connected to lower extents of the members so that such lower extents may be displaced generally parallel to the platform and relative to the base and platform; and the members extend in hyperboloidal configuration for maximum stability and strength, and minimum weight; and in another form of the invention the dampers are integrated into the articulated members, extending in the directions thereof.

Further, as applied to a derrick the compensation system effectively becomes a compensating crown. In essence, the upper portion of the derrick itself becomes the compensating device, effectively reducing the derrick weight. Th union of the hyperboloid design with hydraulic fluid application make this effective.

Additional advantages of the invention includes:

(a) Compression versus force applied is at an exponential rate rather than linear. This exponential increase is absorbed by an inverse exponential mechanical displacement, which eliminates any change in lifting force.

(b) Utilization of this mechanical displacement eliminates the need for high pressure piping or bottles.

(c) The reduced amount of air required makes it very advantageous to use nitrogen as the gas medium, and allows a standard nitrogen generator to be used to charge the system, for safety, (d) The system significantly increases the effectiveiness of the compensation while reducing overall weight, cost of materials and cost of construction.

(e) Provision of an hyperboloidal derrick construction provides increased strength and stability, for the crown positioned compensator.

These and other objects and advantages of the invention, as well as the details of an illustrative embodiment, will be more fully understood from the following specification and drawings, in which:

DRAWING DESCRIPTION

FIG. 7 is a side elevation showing details of a modified compensation structure;

Figure 8:
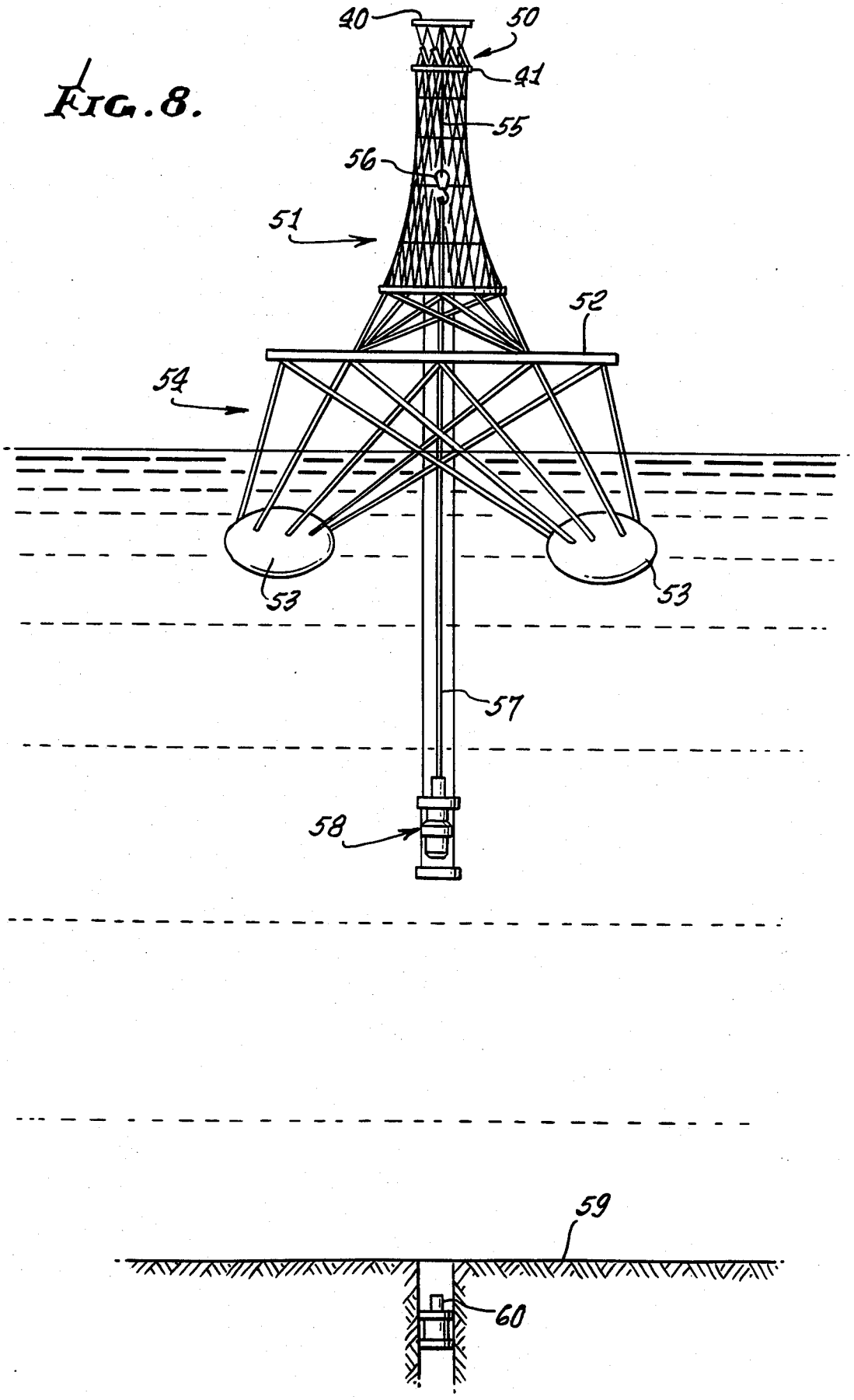
Figure 12:
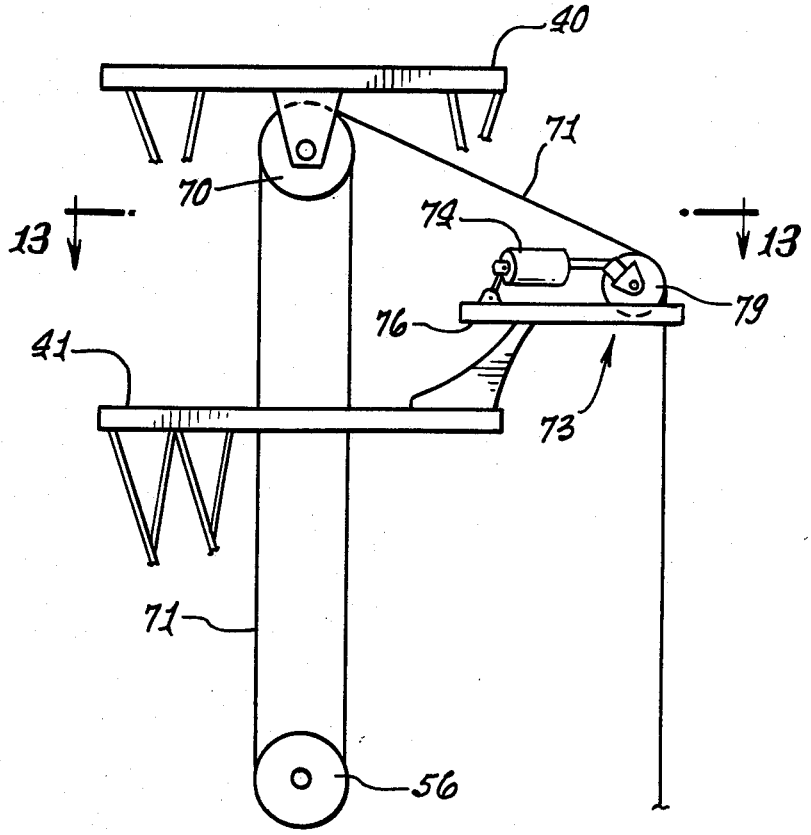
Figure 13:
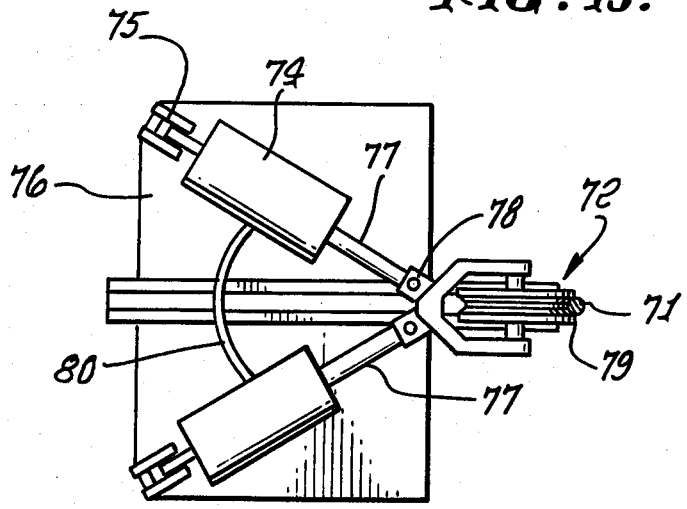

FIG. 7*a* is a fragmentary plan view taken on lines 7*a*—7*a* of FIG. 7;

FIG. 8. is an elevation showing an application of the compensation structure to an offshore well drilling platform;

FIG. 9 is an elevation showing details of any hyperbolodial derrick framework as used in the FIG. 8 platform;

FIG. 10 is an enlarged view showing a typical joint as used in the FIG. 9;

FIG. 11 is a diagram showing relative movement position of a crown block and a sheave for a line connected to the crown block;

FIG. 12 is a fragmentary elevation showing means for controlling displacement of the line connected to the crown block;

FIG. 13 is a plan view taken on lines 13—13 of FIG. 12; and

Figure 14:
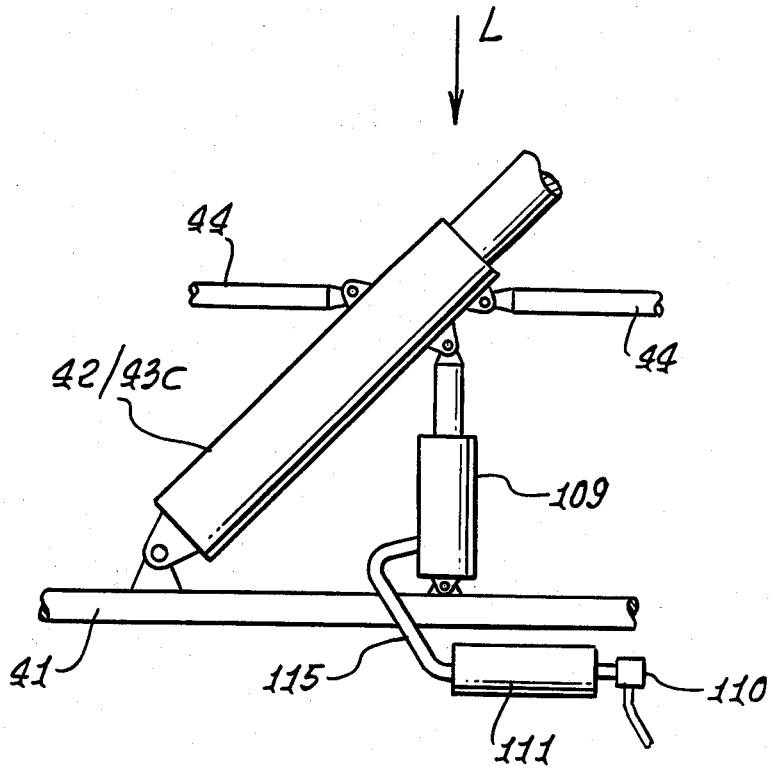

FIG. 14 shows addition of vertical dampening to the FIG. 7 apparatus.

DETAILED DESCRIPTION

Figure 1:
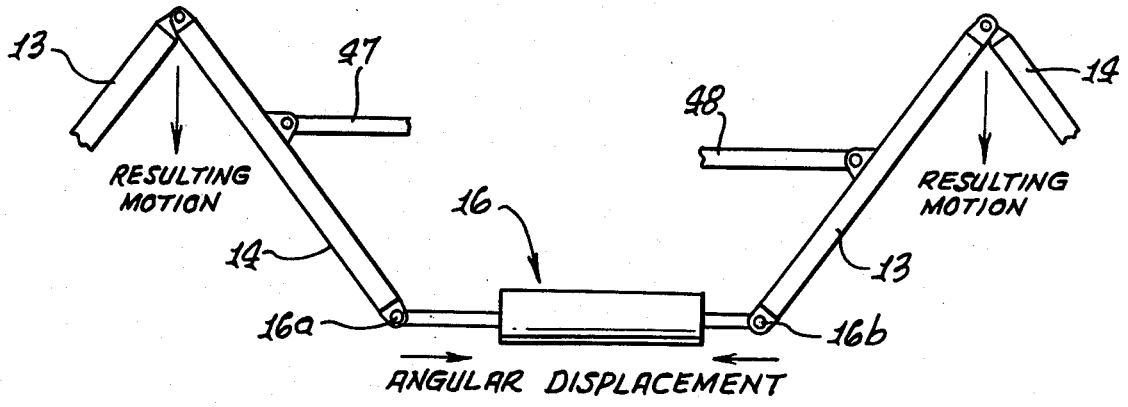
FIG. 1 is a side elevation of articulated support members and an actuator connected to same.
Figure 2:
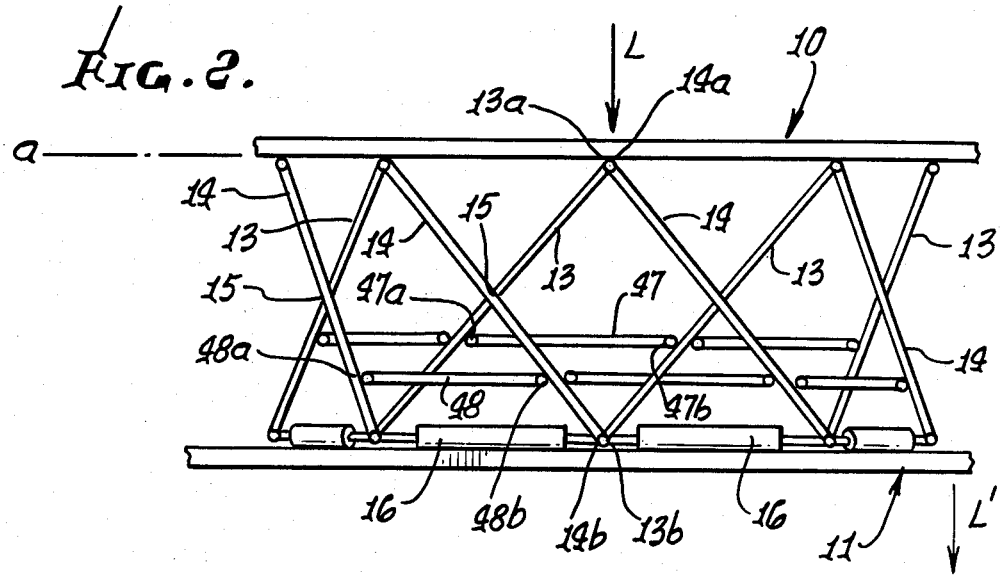
FIG. 2 is a side elevation showing compensation structure embodying the invention in the form of a load bearing platform.
Figure 3:
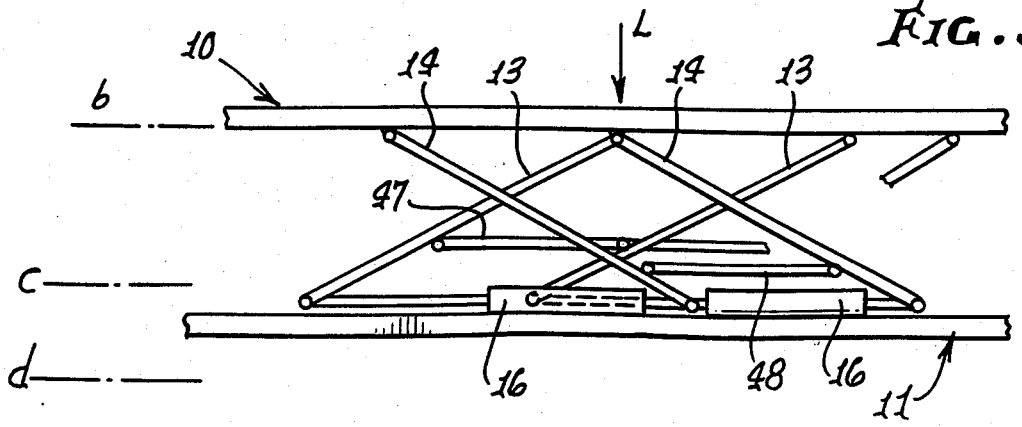
FIG. 3 is a view like FIG. 2 showing the same structure with the top thereof deflected downwardly.

Referring first to FIGS. 1–3, the illustrated load compensation system includes a first element, as for example a platform 10, to receive applied loading, indicated as downward at L. The system also includes a base 11 spaced below the platform. The platform may be circular, as in the case of a helicopter landing pad. It itself exerts downward loading L'.

Means including articulated members supports the first element 10 on the base 11, and acts to resist downward displacement of the element 10 characterized in that the base 11 may move relatively toward and away from the element 10 (or vice versa) while predetermined loading L is applied to same. Thus, for example, if a helicopter lands downwardly on the platform, it yieldably deflects downwardly in compensating relation, say from the level "a" shown in FIG. 2 to level "b" shown in FIG. 3; and thereafter, if the base moves up (say level "c") or downward (say to level "d'), the platform 10 tends to remain at level "b". Such movement of the base may for example occur due to upward heaving of a vessel (ship or offshore drilling rig, etc.), by the sea, and subsequent downward dropping of hte vessel in a wave trough.

More particularly, certain of the articulated members 13 extend longitudinally downwardly and also laterally leftwardly; and others of such members 14 extend longitudinally downwardly and laterally rightwardly; i.e. all members 13 and 14 extend at angles to the platform. As shown, members 13 are pivotally connected at their upper ends to the platform at 13*a;* and upper ends of members 14 are pivotally connected at 14*a* to the platform. Pivots 13*a* and 14*a* for successive links may coincide or closely coincide. The links may be generally circularly arranged in a ring, i.e. to have hyperboloid overall configuration, crossing at loci 15.

Figure 6:
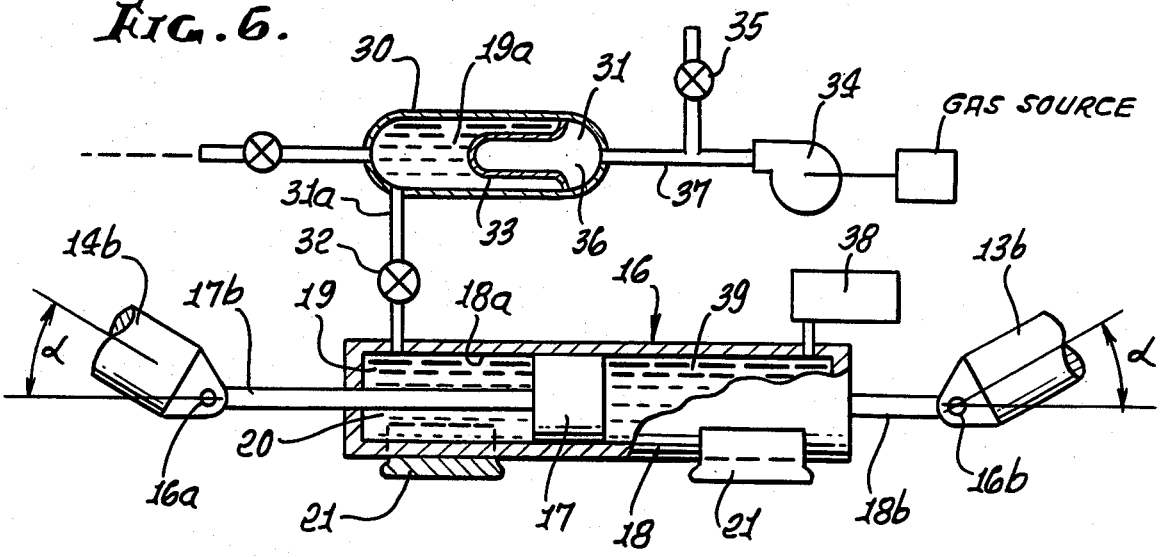
FIG. 6 is an enlarged view, in section showing details of a piston and cylinder type motion damper, utilizing horizontal displacement pairs.

In addition, the means supporting the platform on the base may for example take the form of motion dampers 16 connected to the members 13 and 14 at their lower ends to resist articulated or pivoting of the link members. Such dampers are offset downwardly from the platform and pivotally connected as at 16*a* and 16*b* (see FIG. 6) to lower ends of 13*b* and 14*b* of successive links, so that such lower ends may be displaced generally parallel to the plane of the platform, in response to upward and downward "heaving" movement of the base relative to the platform, whereby the platform tends to remain stabilized in position to compensate for such heaving movement. As shown in FIG. 6, the damper 16 may typically include a piston 17 working lengthwise in the bore 18*a* of cylinder 18, and against the pressure of fluid 19 in chamber 20; cylinder rod 18*b* connects to pivot 16*b*, and piston rod 17*b* connects to pivot 16*a*. The cylinder may be supported as at 21 on the base so that the rods 17*b* and 18*b* and pivots 16*a* and 16*b* move horizontally, parallel to the plane of the platform. See FIG. 3. Links 13 and 14 extend at equal angles $\alpha$ to the axes of the rods 17*b* and 18*b*, and angles $\alpha$ decrease as the base moves upwardly dynamically relative to the platform; but the supporting force exerted on the platform tends to remain the same so that the platform ramains in position. That position is typically the position it assumes under imposed downward static loading, as by helicopter, drill string, or other load source.

Further with regard to FIG. 6, the motion damper may include a liquid containing accumulator 30 connectible as via line 31*a* and valve 32 with chamber 20, and if desired, connectible with the chambers 20 of other cylinder associated with pairs of members 13 and 14. The accumulator also contains a gas pressure reservoir 31, separated from the liquid 19*a* in the accumulator as by a bladder 33. Gas (as for example nitrogen) pressure 36 in reservoir 31 is adjustable by gas pump 34 and outlet valve 35; both commuicating via line 37 with reservoir 31. Thus, the initial hydraulic pressure in chamber 20 may be adjusted to balance the imposed static load L on platform 10, associated with an assumed platform initial position. Thereafter, when the base 11 dynamically heaves up or down, the pistons move in the cylinders against the yieldable resistance of the liquid 19 and gas pressure 36 to accomodate controlled compensating dynamic movement of the link ends 13*b* and 14*b*, as described above, so that the platform remains substantially in assumed initial position. Lubricant 39 is applicable to chamber 20, to lubricate the piston and cylinder base. A lubricant reservoir appears at 38.

Figure 4:
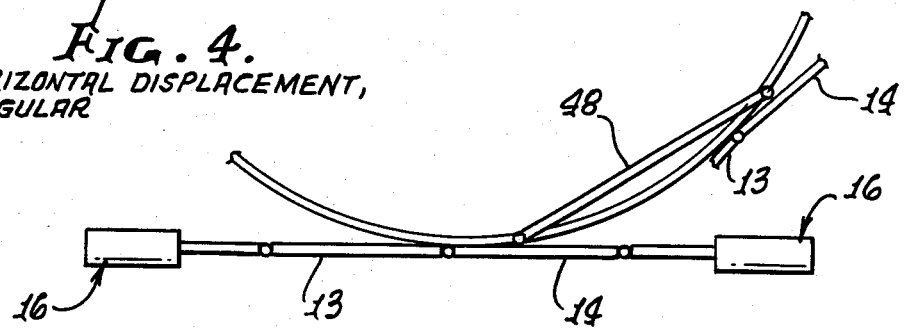
FIG. 4 is a plan view of a portion of the FIG. 2 structure, and utilizing singular horizontal displacement.
Figure 5:
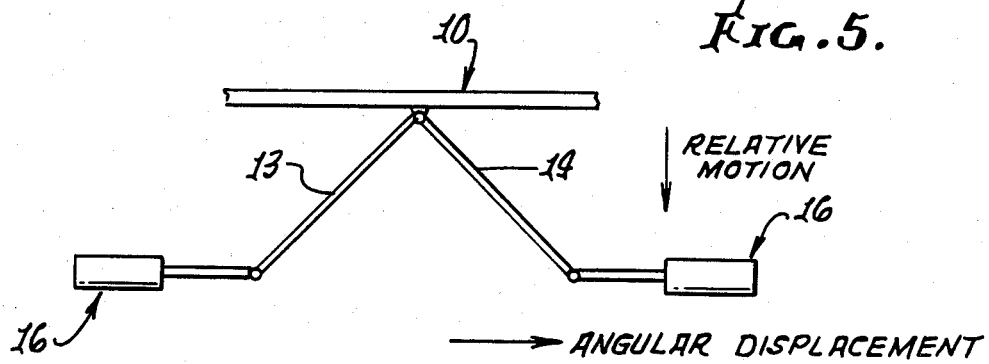
FIG. 5 is a side elevation showing connections between articulated support members and motion dampers.

In the modified arrangement shown in FIGS. 4 and 5, one damper 16 is attached to each link, 13 and 14, as shown.

Also provided are first connectors pivotally interconnecting certain members 13, and second connectors pivotally interconnecting the other members 14. See for example rod connectors 47 pivotally attached at 47*a* and 47*b* to mid-portions of links 13; and rod connectors 48 pivotally attached at 48*a* and 48*b* to mid-portion of links 14. Such rod connectors are to stabilize the mechanism, for example to resist relative rotation of the platform and base, and to resist floating ofthe platform relative to the base, or floating of the base relative to the platform.

Turning to FIG. 7, the modified structure includes a first element such as platform 40, a base 41 below the platform, and means including articulated members 42 and 43 supporting the platform on the base and acting to resist displacement thereof characterized in that the base may move up or down relative to the platform while predetermined loading is applied to the platform which tends to remain in position under applied loading L. Members 42 extend downwardly and laterally leftwardly between pivot connections 42*a* and 42*b* to the platform and base; and members 43 extend downwardly and laterally rightwardly between pivot connections 43*a* and 43*b* to the platform and base. Rods 44 extend horizontally and are pivotally connected at 44*a* and 44*b* to members 42; and rods 45 extend horizontally and are pivotally connected at 45*a* and 45*b* to members 43. Note that the connections are to cylinders 42*c* and 43*c*. See FIG. 7*a* in this regard.

The members 42 and 43 include motion dampers, as shown, each damper having a cylinder as at 42*c* and 43*c* connected to the base, a piston in the cylinder, and piston rods 42*e* and 43*e* connected to the platform. As the base moves or heaves upwardly toward the platform under heaving load, the upward displacement is compensated by displacement of the pistons in the cylinders, as related to pressurized fluid in the cylinders so as to absorb the upward motion without substantially disturbing the level of the static loaded platform. Note that the members 42 and 43 may be arranged circularly about an upward central axis, and that they present an hyperboloidal structural arrangement, affording great stability and strength to the equipment. There are at least three pairs (13 and 14) of such members, in a circular arrangement.

FIG. 8 shows an application of the compensating equipment 50 (of either FIG. 2 and 3, or Fig. 7 type) to a well derrick 51 on a floating offshore platform 52. Underwater floats appear at 53, and structure 54 supports the platform on the floats. The platform 40 (assuming device 50 is of FIG. 7 type) centrally suspends a line 55 carrying traveling block 56. The latter in turn supports a drill string 57 suspending drilling equipment, as for example a well head stack 58 (blowout preventers, accumulators, and well head connector) adapted to be lowered to the sea bed or floor 59, to attach to a riser pipe 60. It is imperative that the heavy expensive stack 58 not impact heavily downwardly on pipe 60 or the well head, the top located compensator 50 preventing such impact. Thus, as the sea heaves the derrick upwardly or downwardly the platform 40 is maintained substantially at predetermined elevation relative to the sea bed or well head as explained above.

FIG. 9 shows the derrick 51 construction to comprise an hyperboloidal arrangement of support members. The latter include linearly elongated support members (steel, or concrete, or both) certain of which, at 61, extend downwardly and laterally along hyperboloidal directrices in one direction about derrick central vertical axis 61. Ties 63 interconnect the members as shown. A typical joint appears at 64 in FIG. 10. Such an hyperboloidal structure saves weight, and optimizes the strength and stability of the derrick, the hyperboloidal compensating unit at the top of the derrick also contributing to reduce weight, and increase strength and stability.

The means exerting a preload on the platform element 40 corresponding to 10 in FIG. 2, in FIG. 12, includes a crown block 70, to which traveling block 56 (that supports the drill string) is connected, as by line 71. The line lower end is connected to a draw works, or other control drum or pulley system, indicated at 72. The latter is supported on the derrick, which heaves up and down in response to sea wave travel, as described above. Thus, unless the effective length of line 71 is also compensated, the blocks 70 and 56 will move up and down relative to the sea floor, even though platform 10 is stabilized. See FIG. 11.

In accordance with a further aspect of the invention, control means (indicated generally at 73) is provided and engages line 71 to extend or shorten its effective length in response to upward and downward movement, respectively, of the drilling platform, whereby the blocks 70 and 56 maintain their elevations relative to the sea bed. In the example, the control means 73 includes two piston and cylinder type actuators or dampers 74 as also shown in FIG. 6. The cylinders are pivotally connected at 75 to derrick structure 76; and the pistons have rods 77 pivotally connected at 79 to the sheave 78 over which line 71 travels. As the derrick heaves up, the inward force exerted on the actuators 74 by the sheave is reduced, whereby the pistons and rods 77 extend (to the right, in FIGS. 12 and 13) due to expansion of gas compressed in the cylinders by the pistons, keeping block 56 from moving relative to the sea floor; and as the derrick drops down, the inward force on the actuators 74 is increased, whereby the pistons and rods 77 move inward (to the left in FIGS. 12 and 13) keeping block 56 from moving relative to the sea floor. The compressed fluid chambers in the cylinders may be connected, as by a line 80 whereby pressures in the fluid chambers are equalized. Also, tracks may be provided for sheave inward and outward movement.

Further, the described dynamic load compensation system of FIGS. 12 and 13 (two dampeners forming an acute angle at a pivot point), the resultant change in fluid pressure, by virtue of alternations in compression chamber size, will be exponentially absorbed, allowing the line load to remain constant.

In any given application of the dynamic load compensation method further vertical dampening may be achieved by the inclusion of an additional dampener 109 pivotally mounted on the base (11) and extending upward to the diagonal member (13 and 14). This modification and the resultant effect of vertical loading can be further regulated by control of the pressure of the vertical dampener compression chamber. This control can be accomplished by fluid pressure regulation at 110 or addition of an accumulator 111 to increase chamber volume, or both, as indicated in FIG. 14, with connection to thedampener at 115. The vertical mounted dampener 109 reduces both vertical and horizontal loading forces, at a proportional rate.

Referring again to FIG. 7, note the alternate connection points 141–145 for the ends of the cylinders 42*c* and 43*c*, on base 41, to adjust the pressures in the dampeners, and to vary the angles of directed pressurization of the dampeners.

I claim:

1. In a dynamic load compensation system, the combination comprising (a) a first element to receive predetermined applied loading, and a base spaced longitudinally from said element, (b) first means including articulated members supporting said first element on said base and acting to resist displacement therefor characterized in that said base may move relatively toward and away from said first element while said predetermined loading is applied to said first element, (c) certain of said members extending longitudinally and laterally leftwardly, and others of said members extending longitudinally and laterally rightwardly, (d) first stabilizing connections including links extending between and pivotally inter-connecting said certain members, said links everywhere spaced from said first element and base, and (e) second stabilizing connections including links extending between and pivotally inter-connecting said other members, said links everywhere spaced from said first element and base, (f) said first means including motion dampers connected to said members in spaced relation to said stabilizing connections.

2. The combination of claim 1 wherein said first element comprises a platform, and said articulated members are pivotally connected to the platform and base to pivot relative to the platform as the platform moves relatively toward and away from said base.

3. The combination of claim 2 wherein said means includes motion dampers connected to said members to yieldably resist pivoting thereof.

4. The combination of claim 3 wherein said dampers include pistons and cylinders, and fluid adapted to be compressed in response to movement of the cylinders relative to the pistons.

5. The combination of claim 4 wherein said platform extends in horizontal direction, and said dampers are offset from said platform and connected to lower extents of the members so that such lower extents may be displaced generally parallel to the platform and relative to the base and platform, said links also extending generally horizontally.

6. The combination of claim 5 wherein said members extend in hyperboloid configuration.

7. The combination of claim 2 wherein said members include motion dampers.

8. The combination of claim 7 wherein said dampers include pistons and cylinders, and fluid adapted to be compressed in response to movement of the cylinders relative to the pistons.

9. The combination of claim 8 wherein said members including said dampers extend in hyperboloidal configuration.

10. The combination of claim 1 including means exerting said predetermined applied loading, longitudinally, on said first element.

11. The combination of claim 10 wherein said first element comprises a helicopter landing platform.

12. The combination of claim 10 wherein said means includes a well string.

13. The combination of claim 12 including a well derrick on which said system is supported.

14. The combination of claim 13 including a floating offshore drilling platform supporting said derrick, whereby as the platform heaves upwardly in response to a rising sea, the base moves upwardly relatively toward the platform, which substantially retains its elevation.

15. The combination of claim 4 including fluid pressure accumulator means connected with said cylinders in fluid pressure communicating relation therewith.

16. The combination of claim 4 including means to adjust the pressure of said fluid in the cylinders.

17. The combiantion of claim 4 wherein said pistons are connected to said members to be displaced as a function of angular pivoting of the members relative to said platform, whereby the extent of said piston displacement decreases as the base moves upwardly toward the platform.

18. The combination of claim 13 wherein said derrick has a framework with support members extending along hyperboloidal directrices.

19. The combination of claim 14 wherein said means includes a crown block suspended from said element, and a line connected to said crown block to raise and lower same, the line also connected to a drum on the derrick, there being control means engaging said line to extend or shorten its effective length in response to said upward or downward movement, respectively, of the drilling platform, whereby the crown block maintains its elevation relative to the sea bed.

20. The combination of claim 19 wherein said control means includes two fluid pressure actuators carried by the derrick, the actuators including pistons and cylinders, one of the pistons and cylinders of each actuator operatively connected to a sheave about which the crown block connected line extends, said actuators extending in diverging relation away from said sheave so that the sheave is yieldably displaced in response to force application thereto from the line during said upward and downward movement of the platform.

* * * * *